United States Patent [19]

Naka et al.

[11] Patent Number: 4,602,766

[45] Date of Patent: Jul. 29, 1986

[54] TOP RAIL OF A HANDRAIL

[75] Inventors: Hiromitsu Naka; Takeshi Miyashiro; Yoshihide Sugimoto, all of Yashio, Japan

[73] Assignee: Kabushiki Kaisha Naka Gijutsu Kenkyusho, Hokkaido, Japan

[21] Appl. No.: 339,455

[22] PCT Filed: Apr. 21, 1981

[86] PCT No.: PCT/JP81/00095

§ 371 Date: Dec. 21, 1981

§ 102(e) Date: Dec. 21, 1981

[87] PCT Pub. No.: WO81/03042

PCT Pub. Date: Oct. 29, 1981

[30] Foreign Application Priority Data

Apr. 21, 1980 [JP] Japan ..... 55-51625

[51] Int. Cl.[4] ..... E04H 17/14

[52] U.S. Cl. ..... 256/59

[58] Field of Search ..... 256/59, 65, 69

[56] References Cited

U.S. PATENT DOCUMENTS

| | | | |
|---|---|---|---|
| 2,869,829 | 1/1959 | Spangberg | 256/65 |
| 4,193,585 | 3/1980 | Eandi | 256/65 |
| 4,220,316 | 9/1980 | Naka et al. | 256/59 |
| 4,289,303 | 9/1981 | Hamm | 256/69 |

*Primary Examiner*—Andrew V. Kundrat

*Attorney, Agent, or Firm*—Wenderoth, Lind & Ponack

[57] ABSTRACT

A top rail for handrails comprises a top rail body formed of soft synthetic resin, semi-hard synthetic resin or synthetic rubber and having a bendable metal core incorporated therein extending in the longitudinal direction thereof. The bendable metal core is bendable under a force in excess of a predetermined value and maintains the top rail body in its bent position when the core is bent together with the body. The bendable metal core can be the form of an elongated solid steel bar, to which a lubricant has been applied to the surface thereof and soft or semi-hard synthetic resin is extruded about the lubricant applied surface to form the top rail body. The bendable metal core can also be in the form of an elongated solid aluminum or aluminum alloy bar, to which is applied adhesive about the surface thereof and soft or semi-hard synthetic resin is extruded about the adhesive applied surface.

7 Claims, 23 Drawing Figures

TOP RAIL OF A HANDRAIL

FIELD OF THE ART

This invention relates to a top rail for use with handrails, which is manufactured in an indefinite length, and is easily cut to the length required for a particular installation, is bent at the installation location under a force in excess of a predetermined value by a simple tool and is installed at the installation location as a single piece without joints. More particularly, this invention relates to such a top rail which is widely employed indoors and outdoors at locations such as walls adjacent staircases, windows, floors in hospitals and roofs in buildings and which comprises a top rail body formed of soft synthetic resin, semi-hard synthetic resin or synthetic rubber and a bendable metal core or cores embedded in the body.

BACKGROUND OF THE INVENTION

There are a variety of handrails for use on walls adjacent staircases, verandas, roofs, windows and floors in hospitals. As to handrails for staircases, there are a variety of types, such as those for use on straight staircases, those used on L-shaped staircases, those used on U-shaped staircases. Since those used on winding staircases and the length, slope and winding configuration of such staircases vary depending upon the type of buildings, the configuration of the staircase handrails also varies widely. Thus, the length and winding configuration of the top rails which form components of such handrails must be based upon the length and winding configuration of the installation areas, e.g. the staircases, verandas, windows or walls where such handrails are installed, and as a result, there are a great variety of top rails having varying configurations.

Therefore, it is quite difficult to produce a standardized top rail applicable to different installations at less expense on a large scale and at present, only a few varieties of standardized top rails are produced on a large scale to be used for a limited variety of buildings such as standardized apartment houses and buildings. Top rails for other types of buildings have to be produced in order to meet particular conditions at the installation area or a top rail portion for a straight portion of a particular handrail installation area and a top rail portion for a winding portion of the installation area must be produced separately. In the latter case, the top rail portion for the straight installation area portion is produced having a standardized length and as to the top rail portion for the winding portion of the installation area, a variety of top rail portions having different winding configurations are produced in advance and a particular one which is suitable to a particular installation is selected out of such top rail portions. The two part type top rail (straight and winding top rail portions) are connected together by means of welding or the like on at the installation site.

However, in the former case, since the particular top rail applicable to only a particular installation area is produced to order, the production cost of the top rail inevitably becomes high, and in the latter case, (two part rail), although the production cost of the top rail may be reduced somewhat, there are problems in precisely aligning the adjacent ends of the straight and winding top rail portions in abutment and also in giving pleasant appearance to the connection between the two top rail portions. Thus, the installation of these conventional top rails is a quite troublesome operation.

Therefore, in order to eliminate the problems inherent in the conventional top rails as described hereinabove, one object of the present invention is to provide a top rail for use with handrails which is produced with an indefinite length and is cut to the length of particular installation area, bent in conformity with the configuration of the installation area and attached to the installation area as a single piece without joints or the use of any connector means.

Another object of the present invention is to provide a top rail for use with handrails which can be produced in a continuous operation at reduced expense and which can be easily attached to an installation area in a simpler operation.

SUMMARY OF THE INVENTION

Thus, according to the present invention, there has been provided a top rail for a handrail which comprises a resilient top rail body and a bendable metal core or cores embedded in the body extending in the longitudinal direction thereof. The top rail body is formed of resilient material such as soft synthetic resin, semi-hard synthetic resin or synthetic rubber, which is bendable and free of any surface deformation such as creases when bent and the bendable metal core is bendable under a force in excess of a predetermined value and maintains the top rail body in its bent condition when bent together with the body. With the above-mentioned construction and arrangement of the components of the top rail of the present invention, the top rail body is produced in an indefinite length by extrusion, cut to the length of a particular installation area installation located, bent by hand in conformity with the configuration with the turns of the installation area by any suitable means, such as by hand, tool or machine, and then attached to the installation area as a single piece without joints. Thus, the top rail for a handrail of the present invention can be produced regardless of the configuration of the installation area and standardized for production at low cost on a large scale. In addition, the connection operation which hithertofore has substantially reduced the top rail installation efficiency is eliminated and the overall installation operation efficiency is substantially enhanced. Furthermore, the appearance of the installed top rail is also substantially improved. The prior art top rail for handrails was required to be cut in conformity with the configuration of the staircase and butt-joined accomodate the winding configuration of the staircase, that is the shorter top rail portion and longer straight top rail portion were required to be prepared separately and then butt-jointed together accommodate the winding of the installation area. On the other hand, the top rail for handrails of the present invention can be freely bent in both the horizontal and vertical directions and also twist and attached to the installation area as one piece along the entire extent of the installation area while being bent in the required orientation. Particularly, since the top rail of the present invention can be freely bent in the required orientation as stated above and does not require the connection operation of the prior art, the top rail can be installed by an unskilled person and is applicable to general domestic use.

Also in the top rail of the present invention, since the top rail body is formed of soft synthetic resin, semi-hard synthetic resin or synthetic rubber, the body can be colored to a desired color in harmony with the environment to thereby enhance its decorative effect and give a soft feeling to the hand.

Furthermore, according to one embodiment of the present invention, the bendable metal core is formed of an elongated solid steel bar and a lubricant applied about the surface of the core and soft or semi-hard synthetic resin is extruded about the lubricant applied surface to form the top rail body. By this construction, when the top rail is bent, the body and metal core slide relative to each other whereby the top rail can be easily bent by hand or a simple tool and installed at the installation area with sufficient strength and rigidity.

Furthermore, according to the present invention, the bendable metal core is in the form of an elongated solid bar formed of aluminum or aluminum alloy, and adhesive is applied about the surface of the core and soft or semi-hard synthetic resin is extruded about the adhesive applied surface to form the top rail body. By this construction, even when the bending stress on the bendable metal core is less than that on the steel core, since the top rail body and bendable core are integrally united together, in spite of the fact that the top rail can be easily bent by hand or a simple tool, the top rail when installed at the installation area has sufficient strength and rigidity.

In the present invention, when the top rail body is formed having an ordinary cross-sectional dimension and the bendable metal core is in the form of a solid round bar formed of steel, aluminum or aluminum alloy, the relationship between the diameter (d) of the bendable metal core and the number of cores employed (n) can be expressed by the following formula:

$$d \leqq \sqrt[5]{\frac{50}{n} \times \frac{8 \times 300}{3.14\sigma}}$$

wherein the unit of d is mm, n is an integer and $\sigma$ is the maximum bending stress (Kg/mm$^2$) of the material. When the bendable metal core is formed of steel, $\sigma = -75$ Kg/mm$^2$, when the core is formed of hard aluminum wire, $\sigma = 20-30$ Kg/mm$^2$ and when the core is formed of soft aluminum wire, $\sigma = 5.5-9.5$ Kg/mm$^2$.

The bendable metal core is, of course, not limited to the above-mentioned ones and the material, cross-sectional configuration, cross-sectional dimension, number of cores and arrangement of the cores within the top rail body are determined depending upon conditions required for the top rail in the installation of the top rail, that is, whether the top rail is required to be bent either in the transverse or longitudinal direction or both in the transverse and longitudinal directions. The metal core is preferably bendable by hand or at least by the use of a mechanical means such as a roll bender or vice and capable of maintaining the top rail in its bent state against the inherent resilience of the top rail body after the bending of the top rail.

The top rail body preferably has an outer peripheral circumference on the order of 60–200 mm (the corresponding transverse width dimension being on the order of 20–50 mm) and may have any cross-sectional configuration such as a true circle, oval, ellipse or triangle having rounded corners, or rectangle or rhomb, provided that the top rail is easily grasped and positively held when the user places his hand or hands on the top rail from above. The top rail itself may be provided on the surface thereof with a thin layer of hard synthetic resin to enhance the appearance of the top rail or the body may be formed with a plurality of circumferentially spaced ribs extending in the longitudinal direction thereof to enhance the grasping property of the top rail. Alternatively, the top rail body may be provided with a suitable luminous member extending in the longitudinal direction thereof.

The top rail has a unitary construction comprising the bendable metal core about which the top rail is extruded and is produced having a length longer than at least the installation area where the top rail is to be installed. The top rail is wound into a roll as necessary, but the winding of the top rail may be performed within the elastic deformation limits of the bendable metal core as the well as plastic deformation limits. In the latter case, it is preferable that the top rail which has the tendency to return to the rolled condition even after the top rail has been stretched in the installation thereof is straightened by any suitable straightening means to remove the tendency.

When the top rail is to be attached to an installation area such as walls adjacent staircases, verandas, roofs, windows or floors in buildings by means of brackets, erect railing members or support bars, the top rail is cut to the length of the installation area and bent in conformity with the configuration of the installation area.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

DETAILED DESCRIPTION OF THE PREFERRED EMBODIMENTS

The present invention will be described in detail referring to the accompanying drawings.

BENDING TEST OF BENDABLE METAL CORES

On the assumptions that (1) when a person of average body weight of about 60 Kg leans on a top rail of a handrail, a load of about 50 Kg is applied to the top rail, (2) that when the person of average body-weight places both of his hands on the top rail and tries to bend the top rail by applying substantially his whole body-weight to the top rail with a space of 30 cm maintained between the hands, a load of 50 Kg is applied to the top rail and (3) that a pair of fulcrums spaced from each other by 30 cm are provided at the areas on the top rail where his both hands are placed, a load of 50 Kg can be applied to the top rail at an intermediate area between the fulcrums to determine whether the bendable metal core or cores embedded in the top rail would bend or not under such conditions of use. Bending tests were made on various metal cores. The materials of the metal cores are steel equivalent to SS30B - D or SS41B - D falling under Material Standard JIS G 3123, mild aluminum wire equivalent to A1070, A1050, A11100 or A1200 falling under Material Standard JIS H 4040 and hard aluminum wire equivalent to A5052, A5056 or A6063 falling under Material Standard JIS H 4040, respectively. The wire may be a solid bar of truly circular cross section. The relationship between the number and diameter of bendable metal cores at the critical bending was examined and the examination results are shown in the following Table.

| | Number of cores | | |
|---|---|---|---|
| Material | 1 | 2 | 3 |
| Steel | 7.9–9.8 mm | 6.3–7.9 mm | 5.5–6.9 mm |
| Mild aluminum Wire | 15.9–19 mm | 12.6–15.1 mm | 11–13.2 mm |
| Hard aluminum Wire | 10.8–12.3 mm | 8.6–9.8 mm | 7.5–8.6 mm |

Taking the results of the tests into consideration the applicant has manufactured for trial various top rail bodies such as top rails which are easily bent by hand and can be installed by bending them manually, top rails which can be bent by hand, but require a vise or the like tool when they are installed especially while being bent in the longitudinal direction, and top rails which cannot be bent by hand and installed by bending them by the use of a tool such as vise or machine such as a roll bender. The top rails were employed in connection with walls adjacent staircases, verandas, roofs, windows or in buildings or the like structures. Embodiments of top rails for handrails of the invention will now be described.

FIRST EMBODIMENT

Figure 1:
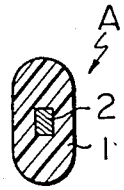
FIG. 1 is a vertically sectional view of a preferable or first embodiment of a top rail for handrails of the invention.
Figure 2:
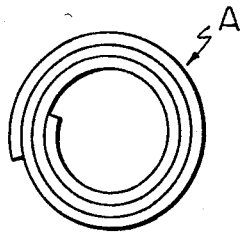
FIG. 2 is a plan view of the top rail of FIG. 1 showing the top rail in its rolled condition.
Figure 3:
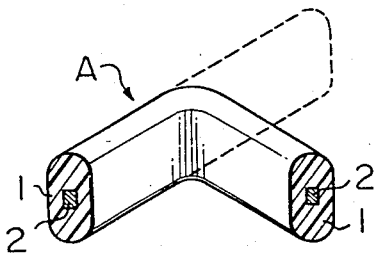
FIG. 3 is a fragmentary perspective view of the top rail of FIG. 1 showing the top rail in its transversely bent condition.
Figure 4:
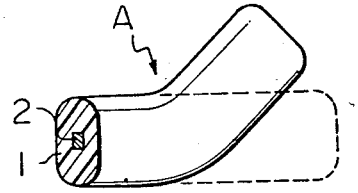
FIG. 4 is a fragmentary perspective view of the top rail of FIG. 1 showing the top rail in its longitudinally bent condition.
Figure 5:
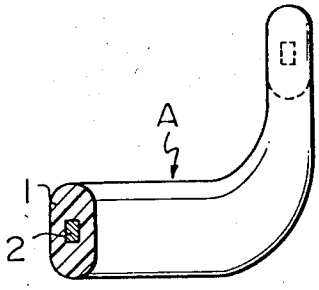
FIG. 5 is a fragmentary perspective view of the top rail of FIG. 1 showing the top rail in its transversely and longitudinally bent condition.

As shown in FIG. 1, Vinyl chloride (containing 50 parts of plasticizer) is extruded so as to form a top rail body 1 of elliptical cross section having a vertical dimension of 40 mm and a horizontal dimension of 20 mm. In the extrusion of the top rail body 1, a bendable metal core 2 is integrally embedded in the center of the top rail body 1 extending in the longitudinal direction of the body. The metal core 2 is formed of a solid rectangular hard aluminum bar having a vertical dimension of 9 mm and a horizontal dimension of 6 mm to provide the top rail A. The top rail A is then rolled by a winding machine into a roll having the outer diameter of 80–100 cm which is within the elastic deformation limit of the bendable metal core 2 as shown in FIG. 2. The top rail A can be bent not only in the transverse direction as shown in FIG. 3, but also in the longitudinal direction as shown in FIG. 4. Furthermore, the top rail A can be bent in both the transverse horizontal and longitudinal directions as shown in FIG. 5. The bending can be easily performed by hand.

Figure 6:
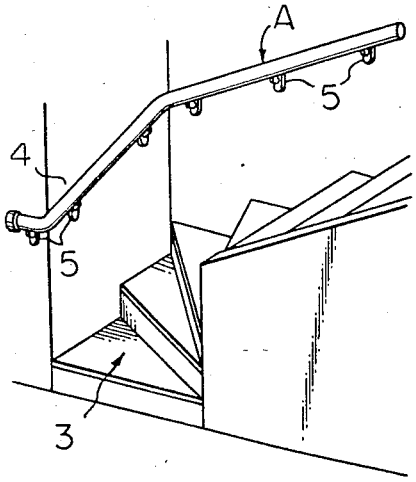
FIG. 6 is a perspective view of the top rail of FIG. 1 showing the top rail as being attached to building walls above a winding staircase by the use of brackets.

When the top rail A is to be installed on the walls adjacent a winding staircase 3 which is commonly provided in general residential houses as shown in FIG. 6, the top rail A is first cut off the roll to a length suitable to the installation area 4 on the walls and the cut top rail is then manually bent in conformity with the contour of the installation area 4 in the longitudinal and transverse directions. In the bending operation, the top rail A is attached to the installation area 4 by means of brackets 5 secured to the area 4 at a uniform spacing of 600 mm from one edge to the opposite edge of the installation area 4.

Figure 7:
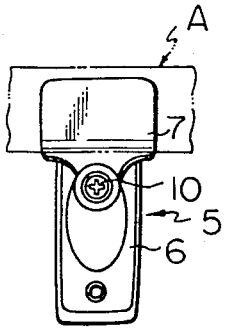
FIG. 7 to 9 are plan, side elevational and cross-sectional views, respectively, of one of the brackets as shown in FIG. 6.
Figure 8:
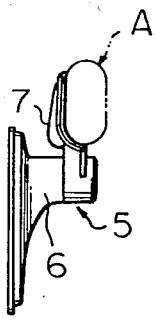
Figure 9:
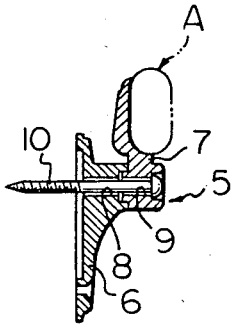

As more clearly shows in FIGS. 7 through 9, the bracket 5 employed in this embodiment comprises a base 6 adapted to be secured to the installation area 4 prior to the installation of the top rail A to the walls and an arm 7 adapted to be secured to the back of the top rail A prior to the installation of the latter. A hole 9 extends through a lower portion of the arm 7 and the base 6. Aligned bores 8 and 9 extend through an upper portion of the base 6 and a lower portion of the arm 7, respectively, and a tapping screw 10 is passed consecutively through the bores 9 and 8 and driven into the installation area 4 to secure the top rail A to the area 4.

Although the top rail A is easily bent by hand in both the transverse and longitudinal directions in conformity with the contour of the installation area 4 and secured to the installation area by means of the screws which extend through the brackets 5 disposed at the uniform spacing of 600 mm along the area 4 and are driven into the installation area, the top rail is imparted sufficient strength and rigidity when secured to the installation area.

SECOND EMBODIMENT

Figure 10:
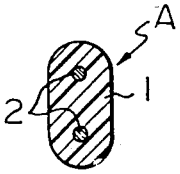
FIG. 10 is a vertically sectional view of a second embodiment of the top rail for handrails of the invention.

As shown in FIG. 10, vinyl chloride (containing 50 parts of plasticizer) is extruded so as to form a top rail body 1 of elliptical cross-section having a vertical dimension of 40 mm and a horizontal dimension of 20 cm. In the extrusion of the top rail body 1, two bendable metal cores 2 are integrally embedded with a vertical space of 25 mm maintained therebetween to form a top rail A of indefinite length. The metal core 2 is formed of a solid truly circular cross-section steel bar having a diameter of 5 mm and anticorrosion oil applied to the surface thereof. As in the case of the first embodiment, the second embodiment can be easily manually bent not only in the transverse direction, but also in the longitudinal direction because the oil on the surface of the bendable metal cores 2 causes the synthetic resin top rail body 1 and metal cores 2 to be easily displaced relative to each other.

Figure 11:
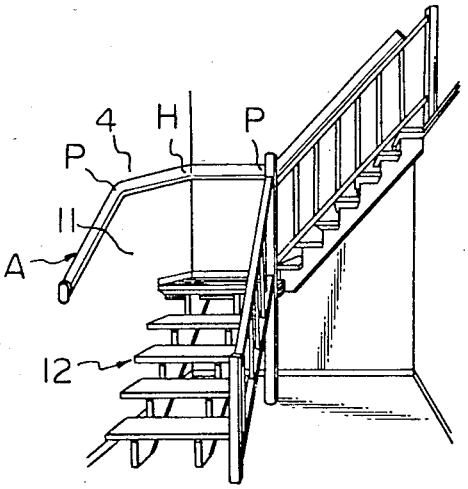
FIGS. 11 to 14 are perspective views showing second, third, fourth and fifth embodiments of the top rail for handrails of the invention showing the embodiments as being employed in connection with different types of staircases.

When the second embodiment of top rail A is to be installed on building walls adjacent a substantially L-shaped staircase 12 having a landing 11 in an intermediate position between the upper and lower ends of the staircase as shown in FIG. 11, the top rail A is first cut to the length of the installation area 4 of walls and then bent in conformity with the contour of the installation area 4, that is, the top rail A is bent substantially in the longitudinal direction at points P at the beginning and terminal ends of the landing 11 and then bent at substantially right angles at point H positioned between points P in the transverse direction and the thus bent top rail A is secured to the installation area 4 by means of the brackets (not shown) in the same manner as described in connection with the first embodiment.

THIRD EMBODIMENT

Although the third embodiment is substantially similar to the second embodiment as shown in FIG. 10, the third embodiment of top rail A has two hard aluminum bar cores 2 of truly circular cross section having a diameter of 6 mm. The third embodiment is also easily bendable by hand both in the transverse and longitudinal directions.

Figure 12:
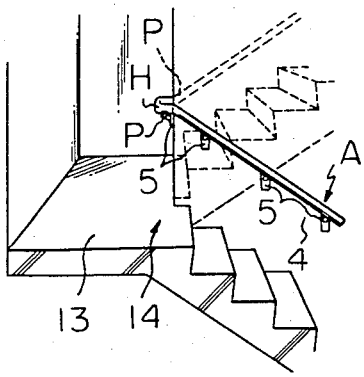

When the third embodiment of top rail A is to be installed on inner walls adjacent a building U-shaped staircase 14 having a landing 13 as shown in FIG. 12, the top rail A is first cut to the length of the installation area 4 of the inner walls and the cut top rail A is bent at points P at the beginning and terminal ends of the landing 13 in the longitudinal direction, and at point H between points P by 180°. The thus bent top rail is secured to the installation area 4 by means of the brackets 5 in the same manner as described in connection with the first embodiment.

Although the third embodiment is substantially similar to the second embodiment, the third embodiment is formed of extruded vinyl chloride (containing 34 parts of plasticizer) and has two spaced solid steel bar cores 2 of truly circular cross section having a diameter of 6 mm embedded therein and anticorrosion oil applied to the surface thereof integrally embedded therein. Although the third embodiment of top rail A may with a great deal of effort be manually bent at normal temperature in both the longitudinal and transverse directions the third embodiment encounters difficulties in installing the top rail on the installation area 4 while bending the same manually. However, experiments have shown that if the rail top is heated to about 50° C. by means of suitable means such as by pouring hot water at 88° C. or applying a heater bag containing hot water against the areas of the top rail where the top rail is bent, the top rail can be relatively easily bent by hand.

Figure 13:
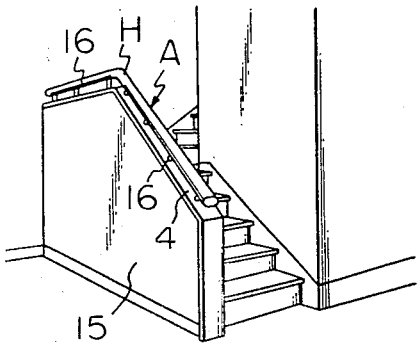

When the fourth embodiment of top rail A is to be installed on the top of a staircase partition wall 15 as shown in FIG. 13, the top rail A is cut to the length of the installation area 4 on the top of the partition wall 15. The cut top rail A is first bent by hand at point H on the top rail A in the transverse direction while being heated to about 50° C. and then attached to the upper ends of a plurality of erect support members 16 secured to the installation area 4 in a uniformly spaced relationship. Different from the foregoing embodiments, the fourth embodiment of top rail A is secured to the installation area 4 with the longer dimension of the elliptical cross-section of the top rail lying horizontally.

FIFTH EMBODIMENT

Although the fifth embodiment is substantially similar to the fourth embodiment, the fifth embodiment of top rail A is formed by extruding vinyl chloride (containing 50 parts of plasticizer) having an indefinite length. The fifth embodiment of top rail A is bent by hand easier than the fourth embodiment of the top rail, in both the longitudinal and transverse directions, but the fifth embodiment of the top rail is not bendable to such a degree that the top rail can be attached to the installation area 4 while being bent by hand.

Figure 14:
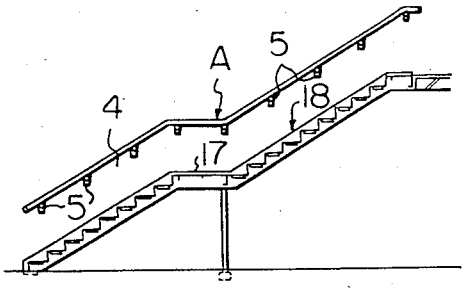

When the fifth embodiment of top rail A is to be attached to the installation area 4 on walls adjacent a straight building staircase 18 having a landing 17 as shown in FIG. 14, the top rail A is first cut to the length of the installation area 4 and then attached to the installation area 4 while being bent in the longitudinal direction in conformity with the winding contour of the installation area 4 on the walls by the use of a simple tool such as a vice or the like and brackets 5 as shown in FIGS. 7 to 9.

SIXTH EMBODIMENT

Although the sixth embodiment is substantially similar to the foregoing embodiments with respect to appearance and shape, the top rail of the sixth embodiment is formed by extruding vinyl chloride (containing 50 parts of plasticizer) and has two spaced solid hard aluminum bar cores 2 of truly circular cross section having a diameter of 5 mm incorporated therein. Furthermore, the top rail body 1 and bendable metal cores 2 are secured together by means of adhesive. Although the sixth embodiment of top rail A can be easily bent by hand in the transverse direction and the metal cores 2 are easily bendable, since no relative displacement occurs between the top rail body 1 and bendable metal cores 2, the strength and rigidity of the top rail is substantially improved and the top rail can not be bent by hand in the longitudinal direction.

Figure 15:
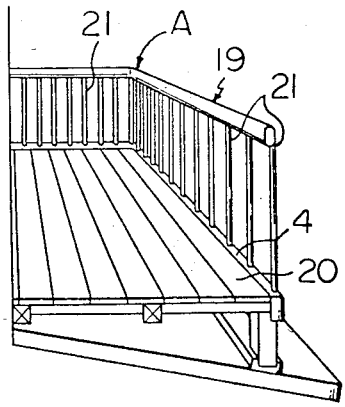
FIGS. 15 and 16 are perspective views of a sixth embodiment of the top rail for handrails of the invention showing the top rail as being attached to walls adjacent a veranda and floor, respectively.
Figure 16:
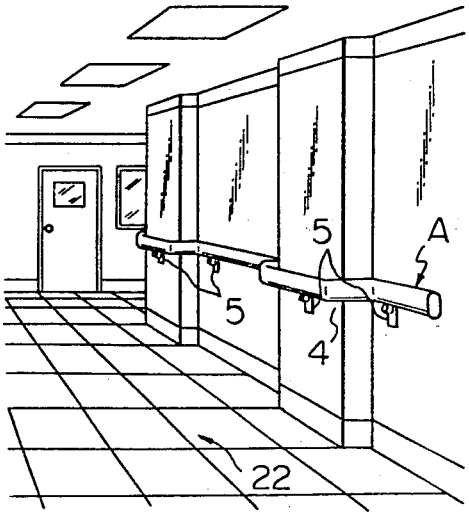

When the sixth embodiment of top rail A is to be attached to a veranda handrail as shown in FIG. 15, the top rail A is first cut to the length of the installation area 4 on the handrail and the cut top rail is bent in the transverse direction in conformity with the winding contour of the installation area 4 and attached horizontally to the upper ends of a plurality of spaced erect railing bars 21. The opposite ends of the top rail A are suitably anchored to walls (not shown).

When the sixth embodiment of top rail is to be attached to walls adjacent a floor 22 in a hospital or the like, the top rail A is first cut to the length of the installation area 4 of the walls and the cut top rail is then attached to the installation area 4 by means of the brackets 5 as shown in FIGS. 7 to 9 while being bent by hand in conformity with the winding of the installation area 4.

Since the sixth embodiment of top rail itself has sufficient strength and rigidity in the longitudinal direction, the top rail is not required to be bent in the longitudinal direction. Thus, it has been found that the sixth embodiment is advantageously employed in connection with indoor and outdoor structures such as varanda, roof and window handrails.

SEVENTH EMBODIMENT

Figure 17:
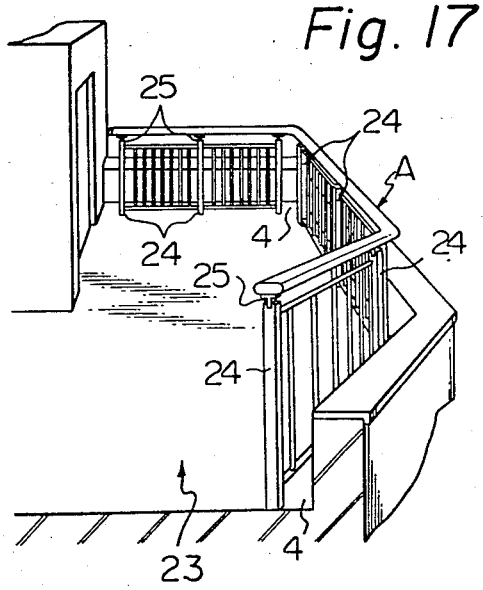
FIGS. 17 and 18 are perspective views of a seventh embodiment of the top rail for handrails of the invention showing the top rail as being employed in the handrail on a roof and that of a spiral staircase in a building, respectively.

The seventh embodiment is similar to the foregoing embodiments with respect to appearance, but the top rail A of this embodiments uses two solid steel bar cores of indefinite length and of truly circular cross section having a diameter of 10 mm, which cannot be bent by hand. When the seventh embodiment of top rail A is to be attached to the installation area 4 on the roof 23 of a building as shown in FIG. 17, prior to the installation, the top rail A is cut to the length of the installation area and the cut top rail A is previously bent in the longitudinal direction in conformity with the winding of the installation area 4 in a factory or at the installation location by the use of a bending machine or tool, and attached horizontally to the upper ends of a plurality of spaced erect support bars 24 at the installation area 4 by means of connectors 25 of substantially T-shaped cross section.

Figure 18:
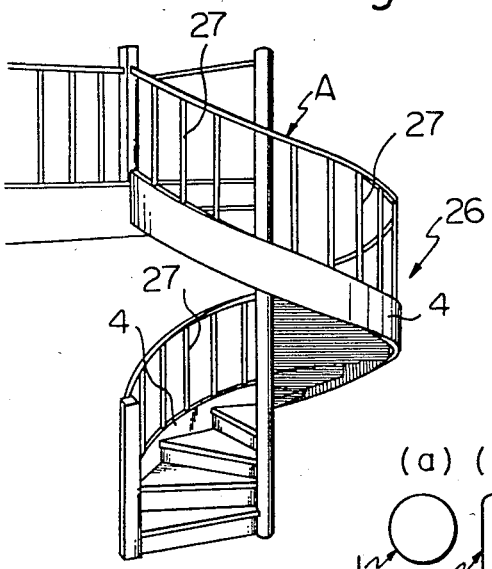
Figure 19:
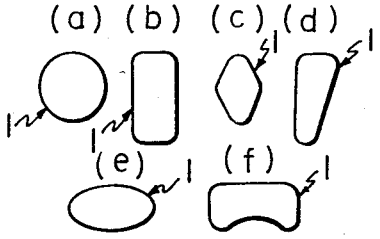
FIGS. 19(*a*) to (*f*) are schematic views of modified top rail bodies of the invention.

The seventh embodiment of top rail A may be wound into a roll of a predetermined diameter prior to the attachment thereof to the installation area 4. When the top rail A is to be attached to walls adjacent a spiral staircase 26 as shown in FIG. 18, the top rail is unwound from the roll and then cut to the length of the installation area 4 on the staircase. The cut top rail A is then bent in both the longitudinal and transverse directions in conformity with the winding of the installation area 4 and attached to the upper ends of a plurality of erect support bars 27 which form a part of the staircase handrail. In this embodiment, if the top rail A is wound into a roll having a winding radius corresponding to the width of the stairs, the top rail A can be quite easily attached to the installation area.

Figure 20:
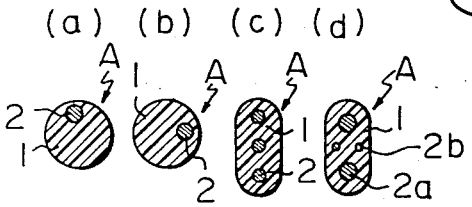
FIGS. 20(*a*) to (*d*) are vertically sectional views showing variation in the number and arrangement of bendable metal cores employed in different embodiments of the top rail for handrails of the invention.

In the various embodiments as described hereinabove, as shown in FIGS. 1 and 10, the top rail body 1 of elliptical cross section of the top rail A has one or two bendable metal cores 2 integrally embedded therein extending in the longitudinal direction. However, the present invention is not limited to such an arrangement of the components. The top rail body 1 may have various cross-sectional configurations such as true circle, ellipse having rounded corners, rhomb, triangle, modified ellipse tapering toward one end, oval and rectangle having an arcuate recess on one longer side as shown in FIGS. (*a*), (*b*), (*c*), (*d*), (*e*) and (*f*), respectively, for example. When the top rail body has a relatively large diameter, the rail body is formed hollow, having an opening extending in the longitudinal direction. As to the bendable metal core 2, one bendable metal core 2 may be eccentrically embedded in the top rail body A extending in the longitudinal direction of the body as shown in FIGS. 20 (*a*) and (*b*), for example. Alternatively, three bendable metal cores 2 having the same diameter (FIG. 20 (*c*)) or two bendable cores 2*a* having a larger diameter and two bendable metal cores 2*b* having a smaller diameter (FIG. 20 (*d*)) may be employed to thereby impart the top rail with rigidity against bending in either the longitudinal or transverse direction or in both directions. Furthermore, taking the rigidity against bending in the longitudinal or transverse direction provided by the metal core or cores into consideration, the configuration of the top rail body is not limited to the ellipse or true circle as seen in the foregoing embodiments, but may be an other configuration. The bendable metal core 2 may be formed hollow within the scope of the invention. Furthermore, in the manufacturing the top rail A, if the top rail body 1 and bendable metal core or cores 2 are designed so that the material or resin of the top rail body is present about the metal core or in a substantially uniform thickness then a defect or defects which may otherwise occur on the surface of the top rail body 1 due to uneven pressure distribution in the resin caused by uneven thickness in the moulding of the top rail body can be eliminated.

Figure 21:
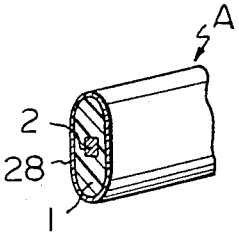
FIGS. 21 and 22 are fragmentary perspective views in vertical section of modifications of the top rail for handrails of the invention.
Figure 22:
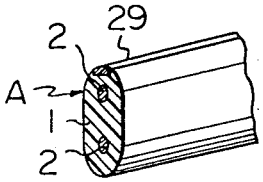
Figure 23:
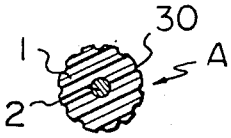
FIG. 23 is a vertical sectional view of a further modification of the top rail for handrails of the invention.

In the foregoing embodiments, although the body 1 of the top rail A is formed of one type of material and has a smooth surface, the present invention is not limited to such a construction of the top rail body. For example, the top rail body 1 may be surrounded by a thin film 28 formed of hard synthetic resin different from that of the body 1 as seen in FIG. 21 or a luminous meterial 29 can be integrally applied to the top of the top rail 1 extending in the longitudinal direction of the body so that the luminous meterial 29 emits light during night hours to thereby indicate the position of the top rail A, as seen in FIG. 22. Alternatively, the surface of the top rail body 1 is provided with a concave-convex design 30 extending in the longitudinal direction thereof to thereby enhance the decorative effect of the top rail body and ensure a positive grasp on the top rail, as shown in FIG. 23.

APPLICATION IN INDUSTRY

In addition of the application of the top rails of the invention as handrail components on staircases, verandas, windows and roofs in buildings and as wall railing means or guard rails on walls adjacent floors in hospitals, the top rails of the invention can be employed as handrails or guard rails on tracks for large size machines, accommodation ladders on ships and aircrafts and baggage elevators.

While various embodiments of the invention have been shown and described in detail it will be understood that these are for the purpose of illustration only and are not to be taken as a definition of the scope of the invention, reference being had for this purpose to the appended claims.

What is claimed is:

1. A top rail for a handrail comprising:

an integral top rail body extruded from a material selected from the group consisting of soft synthetic resin, semi-hard synthetic resin and synthetic rubber; and only one bendable metal core formed of an elongated solid bar, embedded in said top rail body extending in the longitudinal direction of said top rail body, embedded in said top rail body so as to be completely surrounded by said top rail body and bendable under force in excess of a predetermined value so as to maintain said top rail body in its bent state when said core is bent together with said top rail body.

2. A top rail for handrails as in claim 1, in which said bendable metal core is formed of a material selected from the group consisting of steel, aluminum and aluminum alloy.

3. A top rail for handrails as in claim 1, wherein said bendable metal core comprises a plurality of elongated solid bars formed of a material selected from the group consisting of steel, aluminum and aluminum alloy and having different outer diameters.

4. A top rail for handrails as in claim 1, further including a thin film of hard synthetic resin integrally formed on the surface of said body.

5. A top rail for handrails as in claim 2, further including a thin film of hard synthetic resin integrally formed on the surface of said body.

6. A top rail for handrails as in claim 3, further including a thin film of hard synthetic resin integrally formed on the surface of said body.

7. A top rail for handrails as in claim 1, wherein said elongated bar is located eccentrically with respect to the central longitudinal axis of said body.

* * * * *